US008503616B2

(12) United States Patent
Chaves

(10) Patent No.: US 8,503,616 B2
(45) Date of Patent: Aug. 6, 2013

(54) X-RAY TUBE WINDOW

(75) Inventor: Arthur A. Chaves, Draper, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 12/237,285

(22) Filed: Sep. 24, 2008

(65) Prior Publication Data

US 2010/0074411 A1 Mar. 25, 2010

(51) Int. Cl.
*H01J 35/18* (2006.01)

(52) U.S. Cl.
USPC ..... 378/140; 378/141

(58) Field of Classification Search
USPC ..... 378/127, 130, 140, 141, 161
See application file for complete search history.

(56) References Cited

U.S. PATENT DOCUMENTS

| | | | |
|---|---|---|---|
| 2,896,105 | A | 7/1959 | Hosemann |
| 3,610,984 | A | 10/1971 | Seki et al. |
| 3,854,049 | A | 12/1974 | Mistretta et al. |
| 4,107,562 | A | 8/1978 | Koller et al. |
| 4,115,697 | A | 9/1978 | Hounsfield et al. |
| 4,122,967 | A | 10/1978 | Rohrich |
| 4,159,437 | A | 6/1979 | Sahores |
| 4,433,431 | A | 2/1984 | Pfeiler |
| 4,622,687 | A | 11/1986 | Whitaker et al. |
| 4,709,559 | A | 12/1987 | Dotzauer et al. |
| 4,731,807 | A | 3/1988 | Plessis et al. |
| 4,859,849 | A | 8/1989 | Shimura et al. |
| 4,862,490 | A | 8/1989 | Karnezos et al. |
| 4,933,960 | A | 6/1990 | Fijusaki |
| 5,018,181 | A | 5/1991 | Iversen et al. |
| 5,056,126 | A | 10/1991 | Klostermann et al. |
| 5,161,179 | A | 11/1992 | Suzuki et al. |
| 5,173,612 | A | 12/1992 | Imai et al. |
| 5,446,548 | A | 8/1995 | Gerig et al. |
| 5,541,975 | A | 7/1996 | Anderson et al. |
| 5,585,644 | A | 12/1996 | Van Der Borst |
| 5,689,542 | A | 11/1997 | Lavering et al. |
| 5,737,387 | A | 4/1998 | Smither |
| 6,002,745 | A | 12/1999 | Miller et al. |
| 6,005,918 | A | 12/1999 | Harris et al. |
| 6,074,092 | A | 6/2000 | Andrews |
| 6,115,454 | A | 9/2000 | Andrews et al. |
| 6,125,169 | A | 9/2000 | Wandke et al. |
| 6,333,991 | B1 | 12/2001 | Schreiber et al. |

(Continued)

FOREIGN PATENT DOCUMENTS

WO WO 2004062049 A2 * 7/2004

OTHER PUBLICATIONS

James L. Robar et al.; "Tumour Dose Enhancement Using Modified Megavoltage Photon Beams and Contrast Media"; Institute of Physics Publishing; Feb. 5, 2002; pp. 1-18.

*Primary Examiner* — Glen Kao
(74) *Attorney, Agent, or Firm* — Maschoff Brennan

(57) ABSTRACT

In one example embodiment, an x-ray transmissive window includes an inner surface and an outer surface. An x-ray beam emitted by the x-ray system defines a beam path area on the inner surface of the window and a beam path area on the outer surface of the window. The inner surface is arranged for contact with cooling fluid of the x-ray system and is configured to prevent bubbles present in the cooling fluid from accumulating on the inner surface in the beam path area of the inner surface. The outer surface is configured to prevent fluid droplets from accumulating on the outer surface in the beam path area of the outer surface.

21 Claims, 10 Drawing Sheets

U.S. PATENT DOCUMENTS 6,418,193 B1 7/2002 Albagli
6,438,208 B1 * 8/2002 Koller ..... 378/140
6,473,634 B1 10/2002 Barni
6,487,274 B2 11/2002 Bertsche
6,614,878 B2 9/2003 Bogatu et al.
6,950,493 B2 9/2005 Besson
2002/0018544 A1 * 2/2002 Chabin et al. ..... 378/205
2004/0247082 A1 12/2004 Hoffman

* cited by examiner

X-RAY TUBE WINDOW

BACKGROUND OF THE INVENTION

1. The Field of the Invention

The present invention generally relates to x-ray generating devices. In particular, some example embodiments relate to a window configured to substantially prevent the accumulation of bubbles and/or droplets of fluid on one or more surfaces of the window.

2. The Related Technology

X-ray producing devices are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray devices operate in similar fashion. In general, x-rays are produced when electrons are emitted, accelerated, and then impacted upon a material of a particular composition. This process typically takes place within an evacuated enclosure of an x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by a bearing assembly. The evacuated enclosure is typically contained within an outer housing, which also serves as a reservoir for a cooling fluid, such as dielectric oil, that serves both to cool the x-ray tube and to provide electrical isolation between the tube and the outer housing.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted as a beam through windows defined in the evacuated enclosure and the outer housing. The emitted x-ray beam is then directed toward an x-ray subject, such as a medical patient, so as to produce an x-ray image.

Generally, only a small portion of the energy carried by the electrons striking the target surface of the anode is converted to x-rays. The majority of the energy is converted to heat. To help dissipate this heat, the cooling fluid disposed in the outer housing assists in absorbing heat from surfaces of the x-ray tube and removing that heat from the x-ray device. This heat removal can be accomplished, for example, via conduction and/or convection of the heat from the coolant through the outer surface of the housing, and/or by continuously circulating the cooling fluid through a heat exchanger.

Despite the overall success of the cooling fluid in dissipating heat from the x-ray tube, however, certain areas within the x-ray device may not be adequately cooled. One of these areas is located between the respective windows of the x-ray tube and outer housing. Because of this, extreme heating of the cooling fluid in this localized region may occur. This extreme heating can exceed the ability of the cooling fluid to remove the heat. In particular, intermittent boiling of the cooling fluid can occur in the localized region between the two windows, creating air bubbles within the fluid that tend to congregate on the inner surface of the outer housing window.

The accumulation of bubbles at the inner surface of the outer housing window is undesirable for several reasons. Principal among these relates to the fact that the air bubbles present in the cooling fluid at the window surface possess a distinct density, and thus a distinct x-ray attenuation, as compared with the density and consequent attenuation of the fluid itself. Because of this density difference, x-rays passing through a bubbly fluid region will be attenuated to a different extent than x-rays passing through a fluid-only region. Thus, bubbles that are created by intense heating of the cooling fluid and are randomly distributed on the inner surface of the outer housing window create a non-uniform attenuation of the x-ray beam that passes through the window. The result is a non-uniform x-ray beam exiting the x-ray device, which in turn produces inferior results for the particular application for which the device is being used. For instance, in medical imaging, a non-uniform x-ray beam can cause the image quality and clarity of the radiographic images produced thereby to substantially decrease. For this and other reasons, bubbles present at the inner surface of the outer housing window are highly undesirable.

Additionally, the outer housing may be susceptible to leaks such that droplets of the cooling fluid in which the outer housing is immersed can accumulate on the outer surface of the outer housing window. For reasons similar to those identified above with respect to the presence of bubbles at the inner surface of the window, cooling fluid droplets on the outer surface of the outer housing window are undesirable. In particular, the density of the cooling fluid droplets is different than the density of the air present at the outer surface of the outer housing window, causing non-uniform attenuation of the x-rays exiting the x-ray device.

Non-uniform x-ray beam attenuation can be further exacerbated by an additional factor combining with the accumulation of bubbles on the inner surface and/or of fluid droplets on the outer surface of the outer housing window. As mentioned, many x-ray devices are utilized in connection with medical imaging systems, such as CT scanners. In such systems, the x-ray device is typically mounted on a gantry that spins at high speeds during the scanning process. This spinning subjects the x-ray device and its components to various rotationally related forces. These dynamic rotational forces are not of such a nature as to completely displace fluid bubbles formed at the inner surface or fluid droplets accumulating at the outer surface of a typical housing window. However, these forces are sufficient to cause bubbles or fluid droplets at the window surface to oscillate during gantry rotation. This bubble/droplet oscillation further increases the uneven attenuation of the x-ray beam, resulting in even more non-uniform beam characteristics.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF AN EXAMPLE EMBODIMENT

In general, example embodiments of the invention relate to an x-ray transmissive window for an x-ray system.

In one example embodiment, an x-ray transmissive window includes an inner surface and an outer surface. An x-ray beam emitted by the x-ray system defines a beam path area on the inner surface of the window and a beam path area on the outer surface of the window. The inner surface is arranged for contact with cooling fluid of the x-ray system and is configured to prevent bubbles present in the cooling fluid from accumulating on the inner surface in the beam path area of the inner surface. The outer surface is configured to prevent fluid droplets from accumulating on the outer surface in the beam path area of the outer surface.

These and other aspects of example embodiments of the invention will become more fully apparent from the following description and appended claims.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to the figures wherein like structures will be provided with like reference designations. It is understood that the figures are diagrammatic and schematic representations of presently preferred embodiments of the invention, and are not limiting of the present invention, nor are they necessarily drawn to scale.

FIGS. 1-12 disclose various aspects of some example embodiments of the invention. Embodiments of the x-ray transmissive window may, among other things, help ensure substantially uniform x-ray beam transmission by substantially preventing the accumulation of cooling fluid bubbles and/or cooling fluid droplets in the region of the window through which the x-ray beam passes. Embodiments of the x-ray transmissive window may alternately or additionally operate as a flattening filter to reduce the heel effect. Note that the principles disclosed herein can also be applied to other x-ray devices or fluid-filled apparatus where bubble and droplet accumulation on a window or similar component is to be avoided.

As used herein, "fluid" is understood to encompass any one of a variety of substances that can be employed in cooling and/or electrically isolating an x-ray or similar device. Examples of fluids include, but are not limited to, de-ionized water, insulating liquids, and dielectric oils.

I. Example Operating Environment

Figure 1:
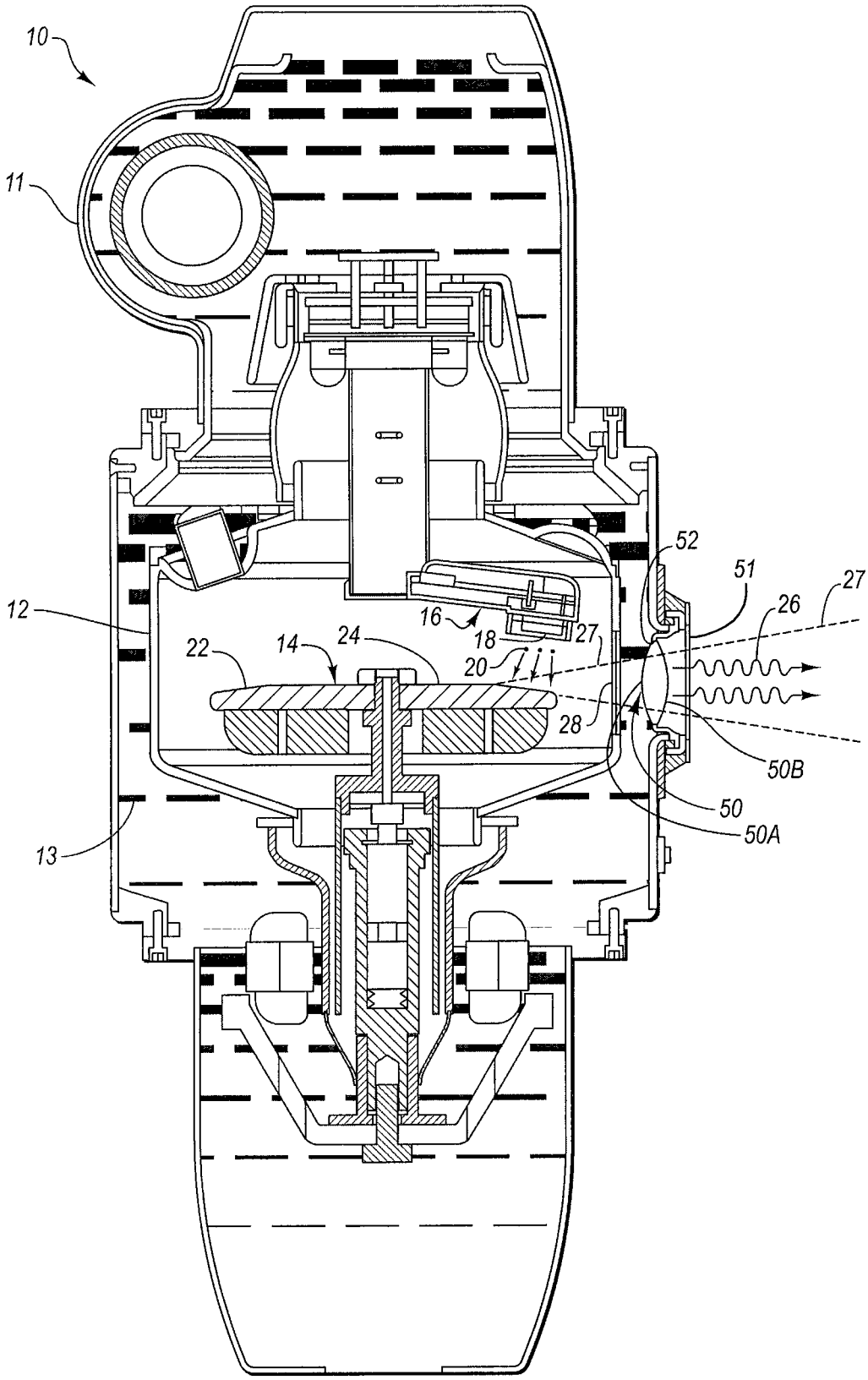
FIG. 1 is a simplified cross-sectional depiction of an x-ray device incorporating a first example housing window according to an embodiment of the invention.

Reference is first made to FIG. 1, which illustrates a simplified structure of a rotating anode-type x-ray tube, designated generally at 10. X-ray tube 10 includes an outer housing 11, within which is disposed an evacuated enclosure 12. A cooling fluid 13 is also disposed within the outer housing 11 and circulates around the evacuated enclosure 12 to assist in x-ray tube cooling and to provide electrical isolation between the evacuated enclosure 12 and the outer housing 11. In some embodiments, the cooling fluid 13 may comprise dielectric oil, which exhibits desirable thermal and electrical insulating properties for some applications, although cooling fluids other than dielectric oil can alternately or additionally be implemented in the x-ray tube 10.

Disposed within the evacuated enclosure 12 are a rotating anode 14 and a cathode 16. The anode 14 is spaced apart from and oppositely disposed to the cathode 16, and is at least partially composed of a thermally conductive material such as copper or a molybdenum alloy. The anode 14 and cathode 16 are connected within an electrical circuit that allows for the application of a high voltage potential between the anode 14 and the cathode 16. The cathode 16 includes a filament 18 that is connected to an appropriate power source, and during operation, an electrical current is passed through the filament 18 to cause electrons, designated at 20, to be emitted from the cathode 16 by thermionic emission. The application of a high voltage differential between the anode 14 and the cathode 16 then causes the electrons 20 to accelerate from the cathode filament 18 toward a focal track 22 that is positioned on a target surface 24 of the rotating anode 14. The focal track 22 is typically composed of tungsten or a similar material having a high atomic ("high Z") number. As the electrons 20 accelerate, they gain a substantial amount of kinetic energy, and upon striking the target material on the focal track 22, some of this kinetic energy is converted into electromagnetic waves of very high frequency, i.e., x-rays 26, shown in FIG. 1.

The focal track 22 is oriented so that emitted x-rays are directed toward an evacuated enclosure window 28. The evacuated enclosure window 28 is comprised of an x-ray transmissive material that is positioned within a port defined in a wall of the evacuated enclosure 12 at a point proximate the focal track 22.

According to some embodiments of the present invention, an outer housing window 50 is disposed so as to be at least partially aligned with the evacuated enclosure window 28, as generally shown in FIG. 1. Optionally, a third window 51 can be disposed so as to be at least partially aligned with the evacuated enclosure window 28 and/or outer housing window 50.

Also comprised of an x-ray transmissive material, such as aluminum, the outer housing window 50 is disposed in a port 52 defined in a wall of the outer housing 11. As will be described, the window 50 can be attached in a fluid-tight arrangement either directly or indirectly to the outer housing 11 so as to enable the x-rays 26 to pass from the window 28 in the evacuated enclosure 12 and through the outer housing window 50. At the same time, the window 50 is configured to prevent the accumulation thereon of bubbles formed in the cooling fluid 13 on the inner surface 50A and cooling fluid droplets on the outer surface 50B that can otherwise cause non-uniform attenuation of the x-ray emission from the tube 10. The x-rays 26 that emanate from the evacuated enclosure 12 and pass through the outer housing window 50 may do so substantially as a conically diverging beam, the path of which is generally indicated at 27 in FIG. 1, and also in FIGS. 2 and 3.

Figure 2:
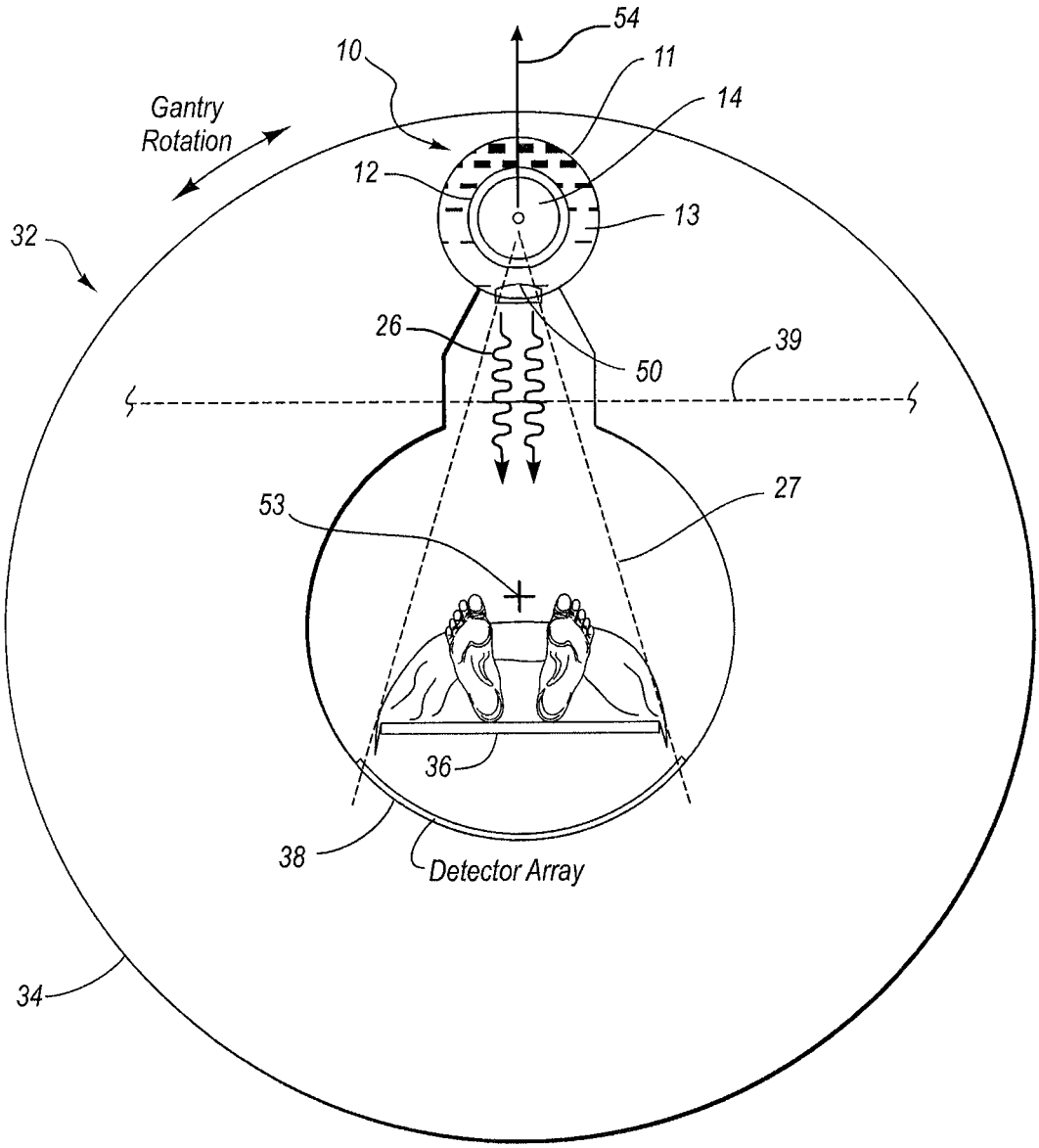
FIG. 2 is a depiction of one environment wherein an x-ray device including an embodiment of the present housing window may be used.

Reference is now made to FIG. 2, which depicts one operating environment in which an x-ray tube having an outer housing window made in accordance with embodiments of the present invention can be utilized. FIG. 2 shows a CT scanner depicted at 32, which generally comprises a rotatable gantry 34 and a patient platform 36. An x-ray tube, such as the x-ray tube 10 depicted in FIG. 1, is shown mounted to the gantry 34 of the scanner 32. In operation, the gantry 34 rotates about a patient lying on the platform 36. The x-ray tube 10 is selectively energized during this rotation, thereby producing a beam of x-rays that emanate from the tube as the x-ray beam path 27. After passing through the patient, the x-rays are received by a detector array 38. The x-ray information received by the detector array 38 can be manipulated into images of internal portions of the patient's body to be used for medical evaluation and diagnostics.

In FIG. 2, the x-ray tube 10 of FIG. 1 is shown in cross section and depicts the outer housing 11, the evacuated enclosure 12, and the anode 14 disposed therein, at which point the x-rays in beam path 27 are produced. The x-ray tube 10 further shows the outer housing window 50, in accordance with one embodiment of the present invention, disposed in the outer housing 11 adjacent the cooling fluid 13. As will be seen, the outer housing window 50 is designed and constructed as to substantially prevent the accumulation of fluid droplets on outer surface 50B and/or bubbles formed in the cooling fluid 13 during operation of the x-ray tube 10 on inner surface 50A. Thus, problems such as non-uniform attenuation of the x-rays in beam path 27, caused by bubbles and/or droplets on one or more surfaces of the window 50 and exacerbated by gantry rotation, may be substantially avoided.

With continued reference to FIG. 2, the term "level" will now be defined for later use below. As used herein, "level" is defined as a plane substantially normal to the direction of the g-force exerted on the x-ray tube 10 (and x-ray window 50) as a result of the rotation of the gantry 34. In the embodiment of FIG. 2, the x-ray device is mounted on the gantry 34, which rotates about gantry axis 53. The high-speed rotation of the gantry 34 accelerates the x-ray tube 10 towards the axis of rotation 53, where the resulting g-force exerted on the x-ray tube 10 can be represented by an arrow 54 directed from the x-ray tube 10 away from the axis of rotation 53. One skilled in the art will appreciate, with the benefit of the present disclosure, that the force due to gravity is negligible at high rotational speeds, such that the g-force exerted on the x-ray tube 10 can be represented by the arrow 54 pointing from the x-ray device away from the axis 53, whether the x-ray tube 10 is above the patient as shown, below the patient, to the side of the patient, or at any other location on the gantry 34. Thus, "level" refers to any plane that is substantially normal to the g-force 54 acting on the x-ray tube 10/x-ray window 50, for example, plane 39 in FIG. 2.

II. First Example Housing Window

Figure 3:
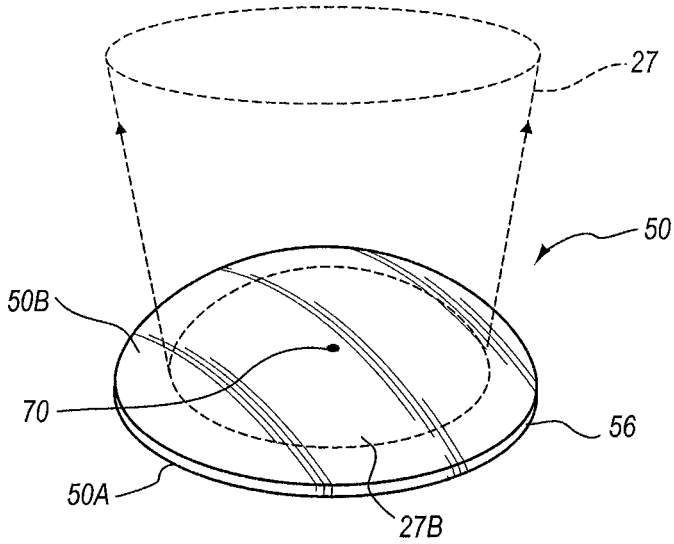
FIG. 3 is a perspective view of the example housing window seen in FIG. 1.
Figure 4:
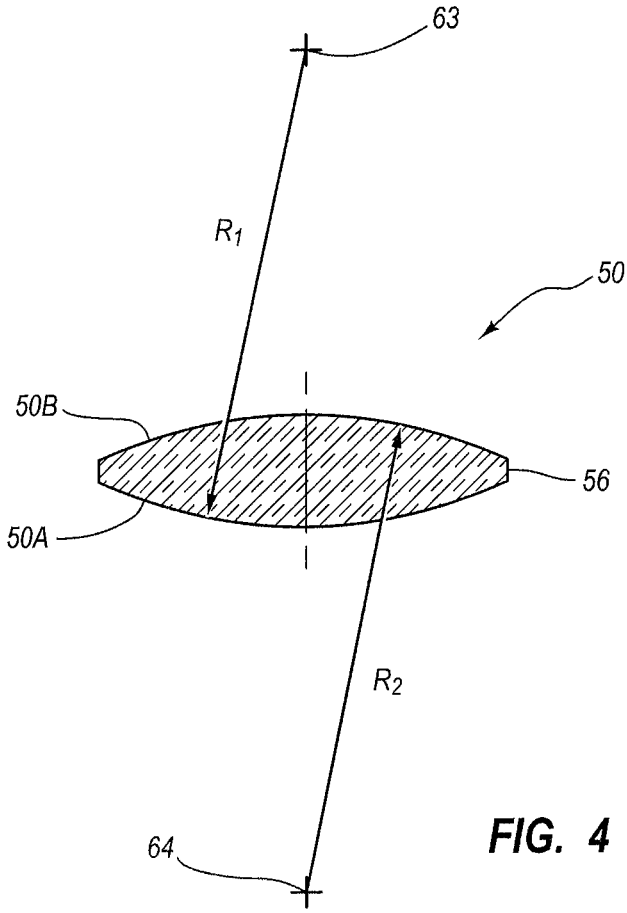
FIG. 4 is a cross-sectional view of the example housing window of FIG. 3.

Reference is now made to FIGS. 3 and 4 in disclosing further details concerning the example outer housing window 50. In FIG. 3, the x-ray beam path 27 is shown in dashes as the volume through which the x-rays 26 (see FIG. 1) would pass if the window 50 were attached to an operating x-ray tube. Thus, the window 50 intercepts a circular slice 27B of the x-ray beam path 27 on an outer surface 50B of the window 50, as well as a circular slice (not shown) of the x-ray beam path 27 on an inner surface 50A of the window 50. It is from these areas that embodiments of the invention are most concerned with removing and/or preventing bubbles from the inner window surface 50A and droplets from the outer window surface 50B.

As its name implies, the inner surface window 50A of the window 50 is disposed in the port 52 of the outer housing 11 so as to come in contact with the cooling fluid disposed in the outer housing 11 as seen in FIG. 1. A periphery 56 of the window 50 may be attached to the port 52 via any suitable means of attachment, such as brazing or welding, such that a fluid-tight seal between the window and the outer housing 11 may be established. Alternatively, the window 50 can be indirectly attached to the outer housing 11 via one or more intermediate structures, such as an attachment ring (not shown).

As can be seen, the window 50 may comprise an arcuate, bi-convex window 50 having an outer periphery 56. Though illustrated as having a circular outer periphery 56, the window 50 can alternately have a periphery of a different shape, such as rectangular, elliptical, square, polygonal, or the like, or any combination thereof. The window 50 can be manufactured from a variety of suitable x-ray transmissive materials, including, but not limited to, aluminum, beryllium, and/or various other metals.

The bi-convex cross-section of the window 50 creates non-planar window surfaces: outer surface 50B and inner surface 50A, both of which are convex in this example. As disclosed in FIGS. 3 and 4, the curvature of the convex inner surface 50A is described by a first radius $R_1$ defined with reference to a first imaginary point 63. Similarly, the curvature of the convex outer surface 50B is described by a second radius $R_2$ defined with reference to a second imaginary point 64. Thus, the inner surface 50A and outer surface 50B of the window 50 can be individually thought of as comprising a portion of the surface of a sphere described by the radius $R_1$ or $R_2$, respectively. The first radius $R_1$ may be greater than, less than, or equal to the second radius $R_2$. Further, the curvature of both the outer and inner surfaces 50B and 50A can be modified in a variety of ways, as discussed more fully below.

Figure 5B:
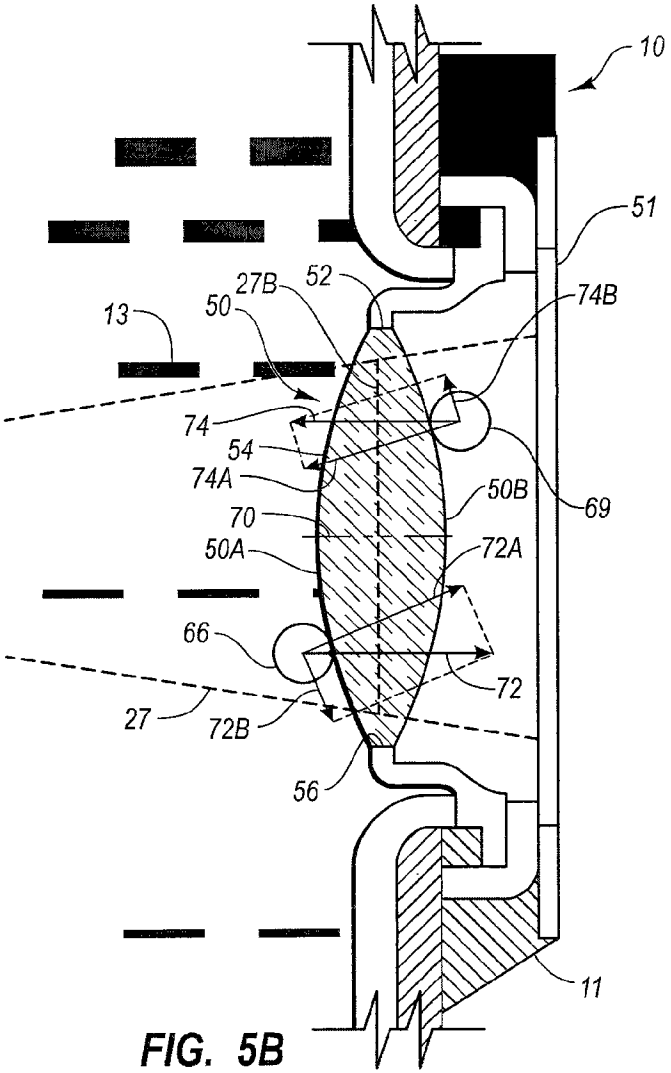
FIG. 5B is a cross-sectional view of the example housing window as in FIG. 5A, showing the bubble and fluid droplet on the window at the inner and outer surfaces, respectively.
Figure 5A:
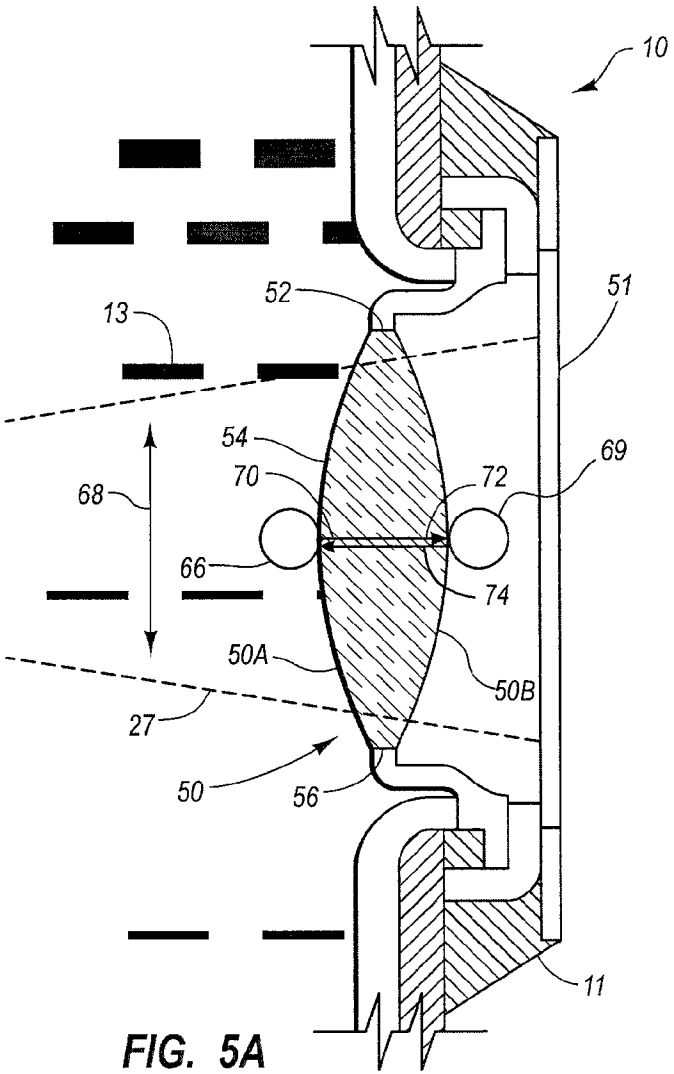
FIG. 5A is a cross-sectional view of the example housing window of FIG. 4 disposed in the x-ray device of FIG. 1, showing an example bubble and fluid droplet disposed on the housing window at the inner and outer surfaces, respectively.

Reference is now made to FIGS. 5A and 5B in describing operation of the example window 50 during operation of the x-ray tube 10. In this example embodiment, the inner surface 50A and outer surface 50B of the window 50 are convexly shaped. As such, the inner window surface 50A serves as one example of a structural implementation of a means for preventing the accumulation of one or more bubbles on the interior of the housing window 50 and the outer window surface 50B serves as one example of a structural implementation of a means for preventing the accumulation of one or more fluid droplets on the exterior of the housing window 50.

During x-ray tube 10 operation, bubbles 66 may form in the cooling fluid 13, which continually circulates within the outer housing 11 adjacent the inner surface 50A. These bubbles 66 may be produced, for instance, by excessive heating within the outer housing 11, which can cause localized boiling of the cooling fluid 13 to occur. One or more bubbles 66 present in the cooling fluid 13 during x-ray tube 10 operation can migrate to and contact the inner window surface 50A. One such bubble is shown in FIG. 5A at 66, disposed in contact with the inner surface 50A of the window 50. During tube operation, a relatively large number of bubbles 66 can accumulate on the inner surface 50A in a portion of the window 50 through which the x-ray beam path 27 passes. As described previously, bubbles 66 that are positioned on the inner window surface 50A in such a manner can cause the x-rays in beam path 27 to be unevenly attenuated and thereby reduce the quality of the image produced in connection with that beam, or cause image artifacts that can lead to misleading or false diagnoses.

Alternately or additionally, a crack or leak in the window 50 or outer housing 11 or at the seal between the window 50 and outer housing 11 may result in cooling fluid 13 leaking onto the outer surface 50B of the window 50. Alternately or additionally, a crack or leak in the outer housing 11 or third window 51 may result in fluid from outside the x-ray tube 10 leaking onto the outer surface 50B. The leaked cooling fluid or other fluid may form one or more droplets 69 that accumulate on the outer window surface 50B. One such cooling fluid droplet is shown at 69, disposed in contact with the outer surface 50B of the window 50 in FIG. 5A. Similar to air bubbles on the inner surface 50A, cooling fluid droplets 69 can accumulate on the outer surface 50B in a portion of the window 50 through which the x-ray beam path 27 passes. Fluid droplets positioned in this manner can cause the x-rays in beam path 27 to be unevenly attenuated and thereby reduce the quality of the image produced in connection with that beam, or cause image artifacts that can lead to misleading or false diagnoses.

According to at least some example embodiments, the window 50 and other embodiments disclosed herein may be configured to simultaneously alleviate both of the above situations. For instance, as previously mentioned, the x-ray tube 10 may be disposed within a rotationally driven system, such as the gantry of a medical imaging device, as illustrated in FIG. 2. The rotation of the imaging device introduces dynamic forces into the x-ray tube 10 during operation. Among these are lateral forces that act upon the bubble 66, as indicated by the lateral arrow 68 in FIG. 5A. Whereas conventional windows having no curvature of the inner window surface are largely unaffected by these lateral forces, the window 50 takes advantage of such forces to remove unwanted bubbles 66 from the window surface, specifically the portion of the window through which the x-ray beam path 27 passes. The convex curvature of the inner window surface 50A creates a surface on which static equilibrium for any bubble disposed thereon is difficult to achieve. Thus, the influence of relatively small moving forces, such as the lateral dynamic forces 68 introduced via rotation or other movements of the x-ray tube 10 described above, may be sufficient to upset whatever equilibrium the bubble 66 may initially achieve on the inner window surface 50A. Even at the intersection of the inner surface 50A with central reference line 70, however, the lateral forces 68 induced in the x-ray tube 10 are sufficient to dislodge a bubble, such as the bubble 66, from its point of unstable equilibrium.

Because of their lack of stable equilibrium, each bubble 66 is easily moved along the inner surface 50A under the influence of forces exerted on x-ray tube 10 during x-ray tube 10 operations. Particularly, a buoyant force 72 induced by rotation of the x-ray tube 10 within the rotational apparatus in which the tube 10 is disposed acts on the bubble 66, as seen in FIG. 5B. This centripetal or centrally directed buoyant force 72 can be resolved into a normal force component 72A, which is directed perpendicularly to the inner window surface 50A at the point of contact with the bubble 66, and a tangential force component 72B, which is directed along a line tangent to the point of contact of the bubble 66 with the inner surface 50A. The tangential force component 72B is unopposed.

The unopposed tangential force component 72B and/or the dynamic lateral forces 68 result in movement of the bubble shown in FIG. 5A from the intersection of the inner surface 50B with the central reference line 70 along the inner surface 50A towards the periphery 56 of the window 50, as seen in FIG. 5B. The bubble 66, under normal conditions, will continue travel in this direction until it has slid off the window 50 completely, or at least far enough so as not to interfere with the x-ray beam path 27. The tangential force component 72B and/or dynamic lateral forces 68 will similarly result in movement of any bubble present on the inner surface 50A of the window 50, regardless of its initial position on the surface. In conjunction with this, it is desirable to manufacture the window 50 so that its inner surface 50A is relatively smooth such that surface friction between any bubbles and the surface is minimized, or at least brought to a level that will not materially impair the effectiveness of the window in preventing bubbles and/or droplets. As a result of the exertion of the tangential force component 72B and/or dynamic lateral forces 68 on bubbles 66, the x-ray beam path 27 at the inner surface 50A of the window 50 is cleared of all bubbles, which in turn increases the energy uniformity of the x-rays 26 passing through window 50 and may substantially prevent variable attenuation that is caused by bubbles present on the window surface.

In a similar manner, the cooling fluid droplet 69 on the outer surface 50B of the window 50 may be displaced from x-ray beam path 27 passing through the window 50. In particular, the rotation of the imaging device introduces dynamic forces that are exerted on the x-ray tube 10 during operation, including the dynamic lateral forces 68. The dynamic forces are sufficient to upset whatever equilibrium the droplet 69 may achieve on the outer window surface 50B. For instance, the fluid droplet 69 may achieve some equilibrium about the vertex of the outer surface 50B, e.g., at the intersection of the outer surface 50B with the central reference line 70. However, the lateral dynamic forces 68 induced in the tube 10 dislodge the fluid droplet 69 from its point of unstable equilibrium.

The lack of equilibrium on the outer surface 50B results in the movement of each droplet 69 along the outer surface 50B. Once the droplet 69 has moved to either side of the central reference line 70 on the outer surface 50B, an unopposed tangential force component acts on the droplet 69 to move the droplet 69 at least far enough so as not to interfere with the x-ray beam path 27.

The motion of the droplet 69 on the outer surface 50B can be explained in the rotating and non-inertial reference frame of the droplet 69. In particular, in the rotating reference frame of the droplet 69, a centrifugal force 74 induced by rotation of the x-ray tube 10 within the rotational apparatus in which the x-ray tube 10 is disposed acts on the droplet 69, as seen in FIG. 5B. The centrifugal force 74 is directed away from the axis of rotation of the x-ray tube 10 and can be resolved into a normal force component 74A, which is directed perpendicularly to the outer window surface 50B at the point of contact with the droplet 69, and a tangential force component 74B, which is directed along a line tangent to the point of contact of the droplet 69 with the outer surface 50B. The tangential force component 74B is unopposed.

The unopposed tangential force component 74B and/or the dynamic lateral forces 68 result in movement of the droplet 69 shown in FIG. 5A from the intersection of the outer surface 50B with the central reference line 70 along the outer surface 50B towards the periphery 56 of the window 50, as seen in FIG. 5B. The droplet 69, under normal conditions, will continue travel in this direction until it has slid off the window 50 completely, or at least far enough so as not to interfere with the x-ray beam path 27. The tangential force component 74B and/or the dynamic lateral forces 68 will similarly result in movement of any droplet present on the outer surface 50B of the window, regardless of its initial position on the surface. Similar to the inner surface 50A, it may be desirable to manufacture the window 50 so that its outer surface 50B is relatively smooth such that surface friction between any droplets and the surface is minimized, or at least brought to a level that will not materially impair the effectiveness of the window in preventing droplets. As a result of the exertion of the tangential force component 74B and/or dynamic lateral forces 68 on droplets 69, the x-ray beam path of the outer surface 50B of the window 50 is cleared of fluid, which in turn increases the uniformity of the x-rays 26 passing through window 50 and may substantially prevent variable attenuation that is caused by fluid droplets present on the outer window surface.

III. Second Example Housing Window

Figure 6:
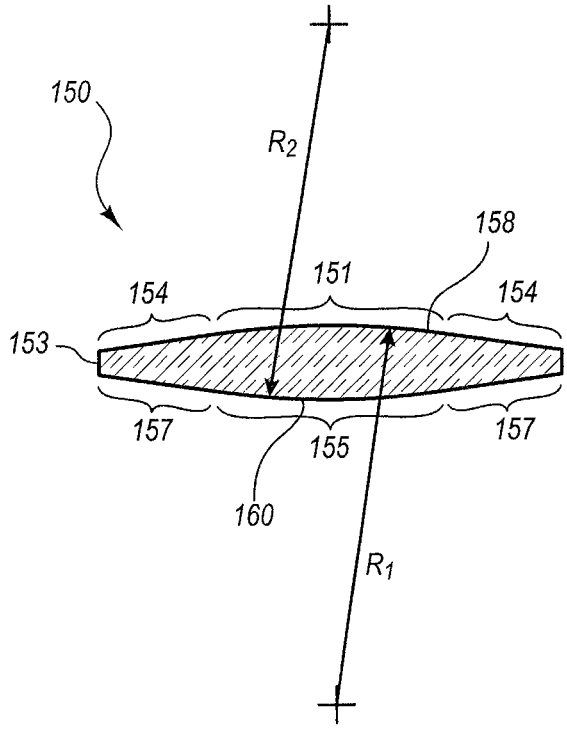
FIG. 6 is a cross-sectional view of a second example housing window.

Reference is now made to FIG. 6. As already suggested, the outer housing window 50 is not limited to the particular shapes disclosed in connection with FIGS. 3-5B and the associated discussion. Accordingly, in the example shown in FIG. 6, an outer housing window 150 having an alternative non-planar shape is depicted. The window 150 comprises a circular periphery 153, outer surface 158 and inner surface 160. The window 150, seen in cross section, includes an arcuate central portion 151 (referred to herein as "first central portion 151") and an outer portion 154 (referred to herein as "first outer portion 154") defining the outer surface 158. Additionally, the window 150 includes an arcuate central portion 155 (referred to herein as "second central portion 155") and an outer portion 157 (referred to herein as "second outer portion 157") defining the inner surface 160.

The first central portion 151 has a curvature defined by a radius $R_1$ and the second central portion 155 has a curvature defined by a radius $R_2$, similar to the previous example window 50 shown in FIG. 4. The first outer portion 154, which is annularly defined about the first central portion 151, and the second outer portion 157, which is annularly defined about the second central portion 155, need not be defined by a radius, but may extend frustoconically about the first and second central portions 151 and 155, respectively. It is appreciated that the width of the first outer portion 154—defined as the shortest distance from the outer periphery 153 to the first central portion 151—may be equal to, greater than, or less than the width of the second outer portion 157—defined as the shortest distance from the outer periphery 153 to the second central portion 155. Similarly, the radius of curvature $R_1$ of the first central portion 151 may be equal to, greater than, or less than the radius of curvature $R_2$ of the second central portion 155.

IV. Third Example Housing Window

Figure 7:
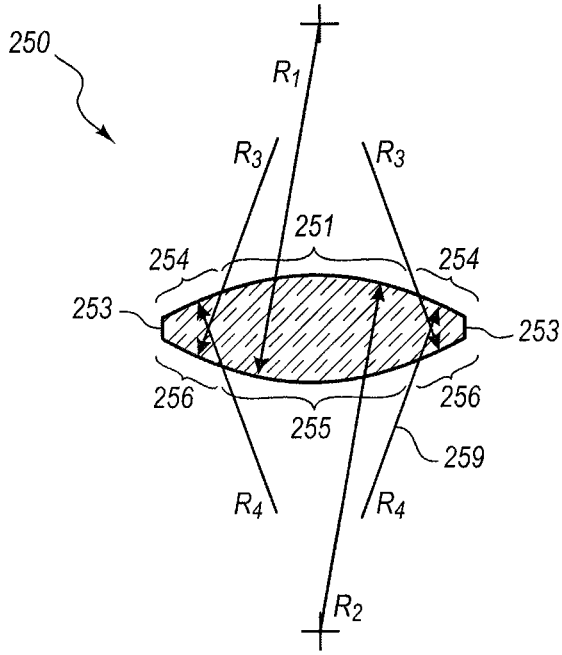
FIG. 7 is a cross-sectional view of a third example housing window.

FIG. 7 discloses another example configuration of an outer housing window. In particular, a window 250 having a substantially circular outer periphery 253 is shown in cross section. The window 250 includes a central portion 251 (referred to herein as "first central portion 251") and an outer portion 254 (referred to herein as "first outer portion 254") annularly disposed about the first central portion 251, the first central portion 251 and the first outer portion 254 defining the outer surface of the window 250. Additionally, the window 250 includes a central portion 255 (referred to herein as "second central portion 255") and an outer portion 256 (referred to herein as "second outer portion 256") annularly disposed about the second central portion 255, the second central portion 255 and the second outer portion 256 defining the inner surface of the window 250.

As seen in FIG. 7, the first central portion 251 possesses a curvature defined by a radius $R_2$ and the second central portion 255 possesses a curvature defined by a radius $R_1$. The first outer portion 254 possesses a curvature defined by a radius $R_4$ which is different than the radius $R_2$. Similarly, the second outer portion 256 possesses a curvature defined by a radius $R_3$ which is different than the radius $R_1$.

Any combination of sizes of radii can be implemented. For instance, the radius $R_4$ may be greater than or less than the radius $R_2$. Similarly, the radius $R_3$ may be greater than or less than the radius $R_1$. Alternately or additionally, the radius $R_4$ may be equal to, greater than, or less than the radius $R_3$. Alternately or additionally, the radius $R_2$ may be equal to, greater than, or less than the radius $R_1$.

The present example is not limited to that depicted in FIG. 7. Indeed, it is appreciated that three or more radii can be used, to define multiple regions on the window inner surface, the window outer surface, or both. This and other modifications of the present example are accordingly contemplated as being within the scope of the invention.

V. Fourth Example Housing Window

Note that the different window configurations shown in FIGS. 4-7 should be considered merely as examples of the variety of window shapes that can be utilized in connection with embodiments of the present invention in order to suit a particular tube application. Accordingly, configurations varying from or in contrast to those explicitly depicted herein are contemplated as also falling within the claims of the present invention.

Figure 8A:
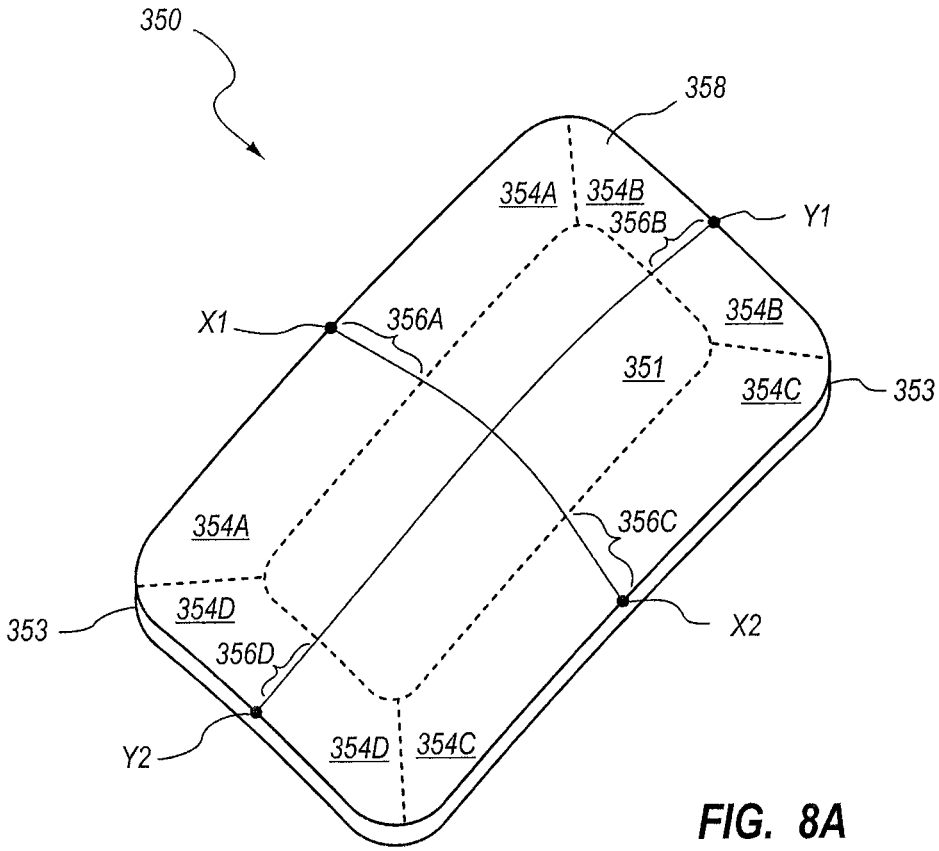
FIGS. 8A and 8B include a perspective view and a cross-sectional view of a fourth example housing window.
Figure 8B:
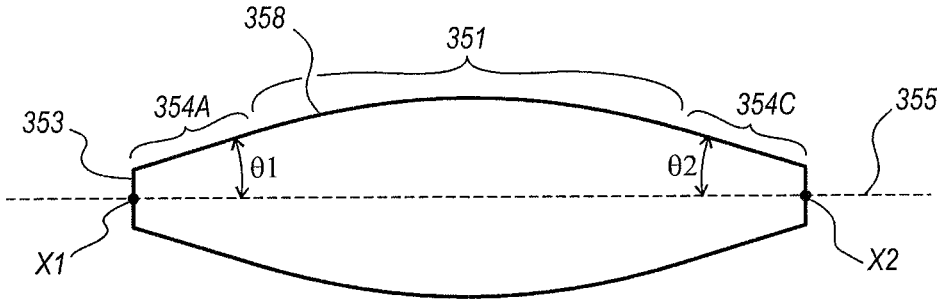

For instance, while the x-ray tube windows illustrated in FIGS. 4-7 include a substantially circular outer periphery 53, 153, or 253, x-ray tube windows having a substantially circular, elliptical, square or rectangular outer periphery or other shape can alternately or additionally be implemented that are similar to or different from the x-ray tube windows 50, 150, and 250 illustrated in FIGS. 4-7. FIG. 8A illustrates a perspective view of one such x-ray tube window 350 having a substantially rectangular outer periphery 353 and an outer surface 358 that includes a convex central portion 351 bounded by one or more substantially planar flat portions. In particular, the convex central portion 351 of the outer surface 358 is bounded by flat portions 354A, 354B, 354C and 354D that collectively define a rim 354. The convex central portion 351 may correspond to the area of the window 350 through which the x-ray beam path 27 passes, although this is not required in all embodiments. The window 350 can additionally include an inner surface (see FIG. 8B) disposed opposite the outer surface 358 that similarly includes a convex central portion bounded by a rim.

It will be appreciated by one of skill in the art, with the benefit of the present disclosure, that either a lateral cross-sectional view along X1 to X2 or a longitudinal cross-sectional view along Y1 to Y2 may appear similar to the cross-sectional view illustrated in FIG. 6. In contrast to the window 150 of FIG. 6, however, the window 350 has a substantially rectangular outer periphery 353, rather than a substantially circular outer periphery 153.

As shown, the radius of curvature of the convex central portion 351 along the X1-*to*-X2 direction may be smaller than the radius of curvature of the convex central portion 351 along the Y1-to-Y2 direction. However, the opposite may alternately be true, or the radii may be equal. Alternately or additionally, in this and other embodiments disclosed herein, including the windows 50, 150, and 250 of FIGS. 4-7, the curvature of the convex portion or portions along a cross-section of each window need not be described by a circular radius (or radii) at all, but may instead be described as a portion of one or more other arcuate shapes, including a parabola, oval, ellipsoid, or the like or any combination thereof.

Returning to FIG. 8A, each portion of the rim 354 is substantially planar and includes a width, defined as the shortest distance from the outer periphery 353 to the convex central portion 351. According to some embodiments of the invention, the plane of each portion of the rim 354 is configured to be angled relative to level during operation, as disclosed in the cross-sectional view of the window 350 illustrated in FIG. 8B. In particular, the plane of each of the flat portions 354A and 354C can intercept a level reference plane 355 at an angle $\theta_1$ and $\theta_2$ that can be the same or different. In a similar manner, the plane of each of the flat portions 354B and 354D can intercept the level reference plane 355 at the same or different angles. By configuring the plane of each portion of the rim 354 to be angled relative to level, fluid droplets present on the outer surface 358 of the window 350 are prevented from finding an equilibrium point and oscillating back and forth as occurs in conventional flat-windowed x-ray devices.

The widths of each of the portions that make up rim 354 are illustrated in FIG. 8A at 356A, 356B, 356C and 356D, referred to collectively herein as "widths 356". The respective widths of each section 356A-356D may all be the same, may all be different, or any combination thereof. The inner surface (not shown) of window 350 can be configured similar to the outer surface 358 with a convex central portion bounded by one or more flat portions having equal or different widths to prevent bubbles formed in the cooling fluid from accumulating on an area of the inner surface of the window 350 through which the x-ray beam path 27 passes.

VI. Fifth Example Housing Window

FIGS. 4-8 illustrate bi-convex window configurations, wherein each of the windows 50, 150, 250, and 350 has both a convex inner surface and a convex outer surface. A variety of other window shapes can be implemented that similarly reduce and/or prevent the accumulation of air bubbles on the inner surface and fluid droplets on the outer surface. Some examples are disclosed in FIGS. 9-12. In particular, FIG. 9 discloses one example of a window 450, shown in cross-section, having an inner surface 452 and outer surface 454 that are substantially planar or flat. However, to prevent and/or reduce the accumulation of air bubbles and fluid droplets on the inner surface 452 and outer surface 454, respectively, the inner and outer surfaces 452, 454 can be configured to be angled relative to level when installed in an x-ray device, such as the x-ray tube 10.

As already explained above, the definition of level depends on the direction of a g-force exerted on an x-ray window—and more particularly, on an x-ray tube in which the x-ray window is implemented—as a result of the rotation of a gantry to which the x-ray tube is operably connected. For instance, the g-force exerted on the x-ray window 450 when implemented in an x-ray tube rotating on a gantry may be represented by the arrow 458 shown in FIG. 9 in some embodiments. Thus, "level" in the drawing of FIG. 9 may correspond to any plane substantially normal to the arrow 458, such as a reference plane 460. Accordingly, each of the inner surface 452 and outer surface 454 intersect the reference plane 460 at angles $\theta_1$ and $\theta_2$, respectively. The angles $\theta_1$ and $\theta_2$ can be the same or different.

The window 450 can optionally include a back wall 456 and/or one or more flanges, sidewalls, or other features which enable mounting of the window 450 into the port 52 defined in the outer housing 11 of the x-ray tube 10 of FIG. 1. However, the back wall 408 is not required in all embodiments and can easily be omitted from the window 450 by appropriately configuring the port 52.

Figure 10B:
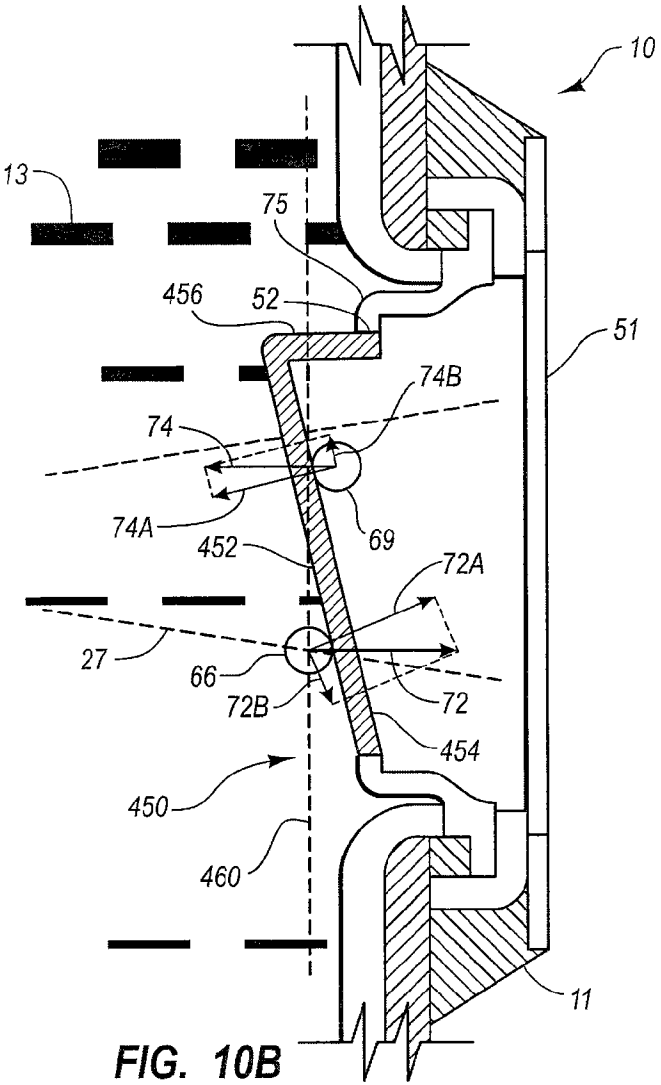
FIGS. 10A and 10B are cross-sectional views of the example housing window of FIG. 9 disposed in the x-ray device of FIG. 1, showing a bubble and fluid droplet disposed in various positions on the housing window.
Figure 10A:
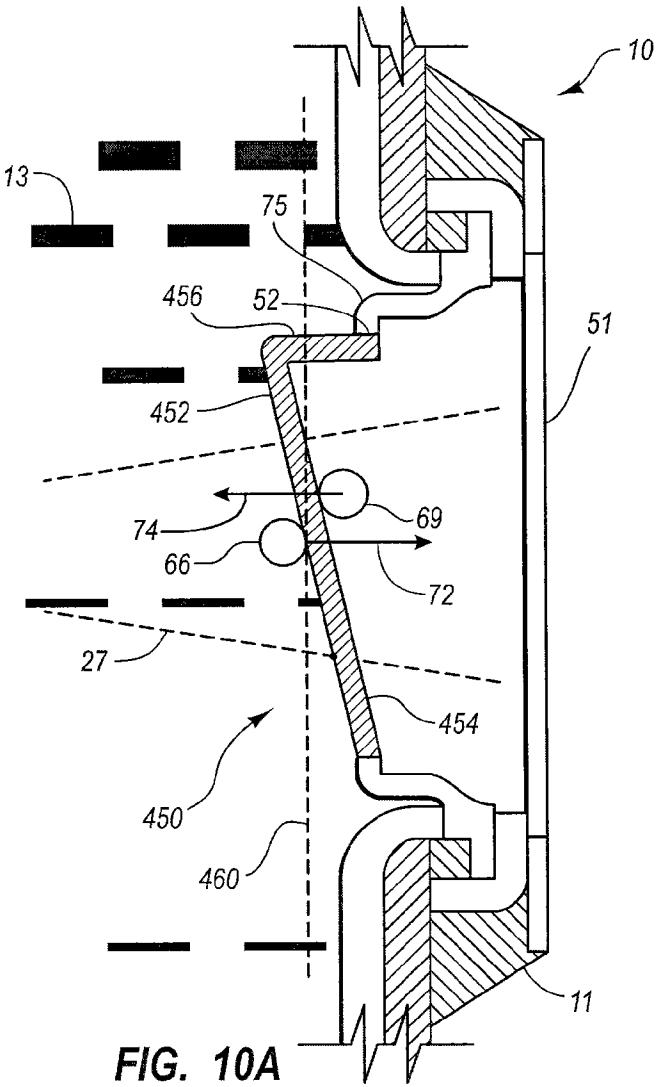

Reference is now made to FIGS. 10A and 10B in describing operation of the window 450 during operation of the x-ray tube 10. As mentioned, the inner and outer surfaces 452, 454 of the window 450 are substantially planar but are configured to be angled relative to level. As such, the inner window surface 452 is one example of a structural implementation of means for preventing the accumulation of bubbles formed in the cooling fluid 13 on the interior of the window 450, and the outer window surface 454 is one example of a structural implementation of means for preventing the accumulation of cooling fluid droplets on the exterior of the window 450.

One example of an air bubble that has migrated to, and is disposed in contact with, the inner surface 452 of the window 450 is shown at 66 in FIGS. 10A and 10B. During x-ray tube 10 operation within a rotationally driven system, the rotations of the system introduce dynamic forces on the bubble 66, including a buoyant force 72. The buoyant force 72 can be resolved into a normal force component 72A which is perpendicular to the plane of the inner surface 452, and tangential force component 72B which is parallel to the plane of the inner surface 452. The tangential force component 72B is unopposed and thus causes movement of the bubble 66 shown in FIG. 10A toward the position shown in FIG. 10B. The bubble 66 will continue to travel in this direction until it has slid off the window 450 completely. Or at the very least, the bubble will be moved by tangential force component 72B a sufficient distance to remove it from the x-ray beam path 27.

One example of a cooling fluid droplet that has accumulated on the outer surface 454 of the window 450 is shown at 69 in FIGS. 10A and 10B. Similar to the air bubble 66, the droplet 69 will be exposed to forces, including a centrifugal force 74, generated as a result of rotations of the x-ray tube 10 within the rotationally driven system. The centrifugal force 74 can be resolved into a normal force component 74A and a tangential force component 74B. The tangential force component 74B is unopposed and thus causes movement of the droplet 69 shown in FIG. 10A toward the position shown in FIG. 10B. The droplet 69 will continue to travel in this direction until it has moved out of the x-ray beam path 27.

In one example, the port 52 defined in the outer housing 11 may be adapted to allow omission of the back wall 456 of the window 450 such that droplets on the outer surface 454 can completely slide off the window 450. For instance, window attachment flange 75 could be extended to compensate for an omitted back wall 456. Furthermore, it may be desirable to manufacture the window 450 so that its inner surface 452 and outer surface 454 are relatively smooth such that surface friction between any bubbles and the inner surface 452 or between any droplets and the outer surface 454 is minimized, or at least brought to a level that allows bubbles and droplets to more easily slide off or move along the inner and outer surfaces 452, 454.

VII. Sixth Example Housing Window

Figure 9:
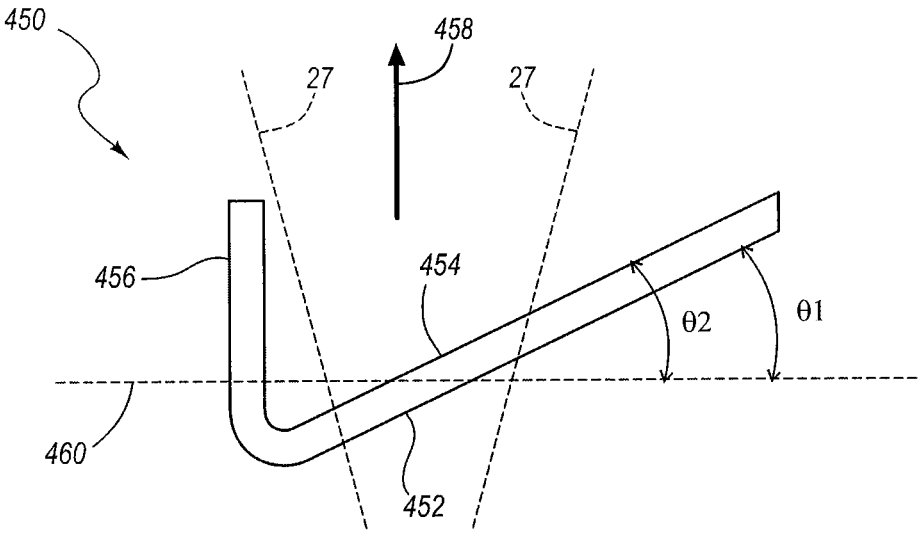
FIG. 9 is a cross-sectional view of a fifth example housing window.

As illustrated in FIGS. 9-10B, the inner surface 452 and outer surface 454 of the window 450 are substantially parallel to each other, a cross-section of the window 450 effectively forming a parallelogram due to the inner surface 452 and outer surface 454 being at the same angle $\theta_1=\theta_2$ with respect to level. However, this is not required in all embodiments of the invention. For instance, embodiments of the invention include x-ray windows having substantially planar inner and outer surfaces and substantially trapezoidal cross sections, one example of which is illustrated in FIG. 11A.

Figure 11A:
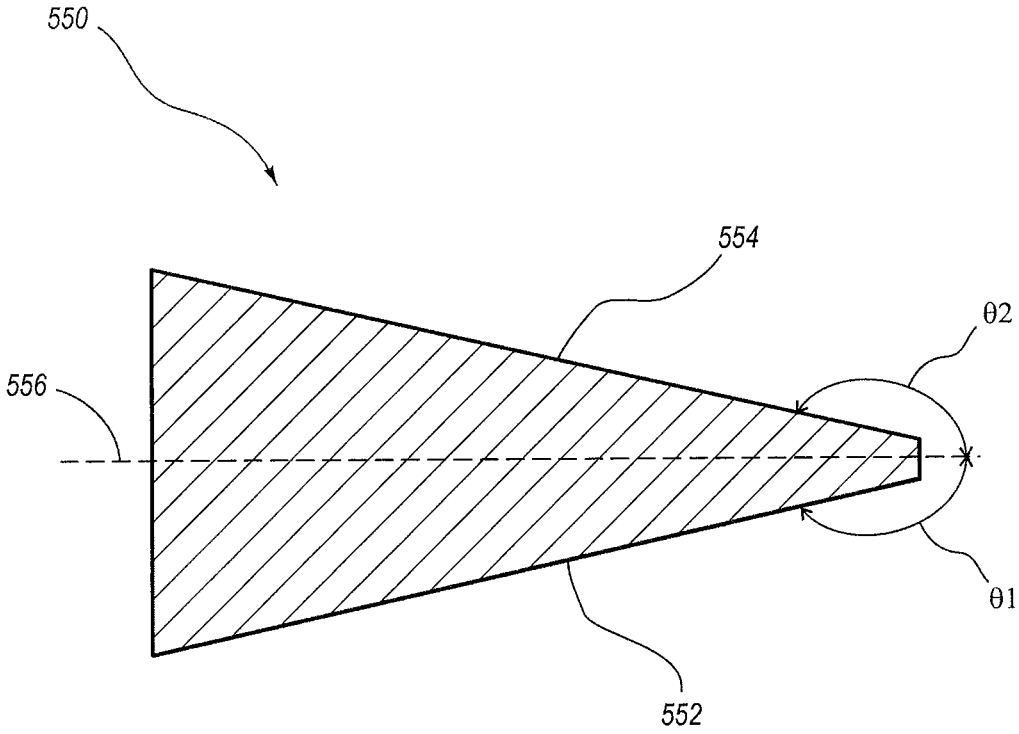
FIG. 11A is a cross-sectional view of a sixth example housing window.
Figure 11B:
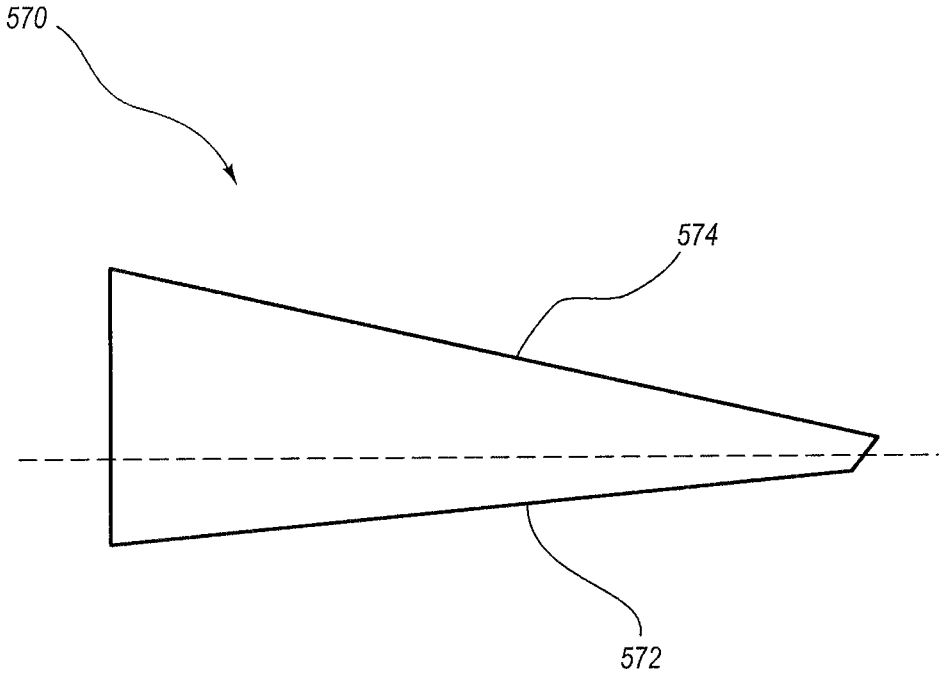
FIG. 11B is a cross-sectional view of a seventh example housing window.

FIG. 11A illustrates an x-ray window 550 having a substantially planar inner surface 552 and a substantially planar outer surface 554, where the inner and outer surface 552, 554 are not parallel to each other. As shown, the inner surface 552 and outer surface 554 are configured to be at different angles $\theta_1 \neq \theta_2$ relative to a level reference plane 556 when installed in an x-ray tube of a rotationally driven system. The cross-section of the window 550 shown in FIG. 11A is in the form of an isosceles trapezoid. Thus, although $\theta_1 \neq \theta_2$, the absolute value of $\theta_1$ can be equal to the absolute value of $\theta_2$ in the embodiment of FIG. 11A. Alternately, window cross-sections according to embodiments of the invention may be in the form of trapezoids other than isosceles trapezoids. Having said that, it should be understood that embodiments of x-ray windows having substantially planar inner and outer surfaces need not have trapezoidal or parallelogram cross-sections at all. See, e.g., FIG. 11B, disclosing an x-ray window 570 having a non-trapezoidal and non-parallelogram cross-section with a substantially planar inner surface 572 and a substantially planar outer surface 574.

Figure 12:
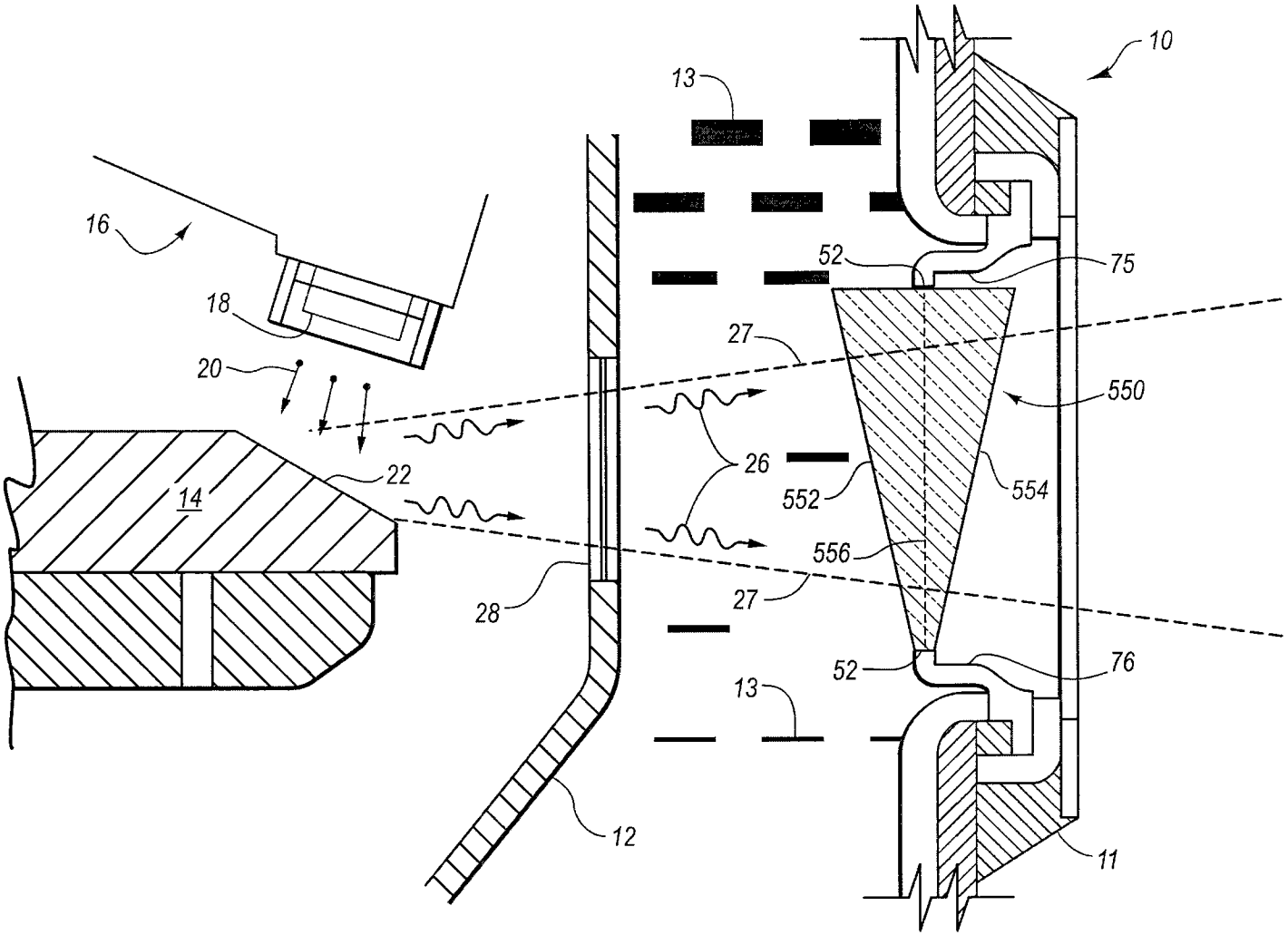
FIG. 12 is a cross-sectional view of the housing window of FIG. 11A disposed within the x-ray device of FIG. 1.

FIG. 12 illustrates an example of an x-ray tube 10 which includes the x-ray window 550 of FIG. 11A. Similar to the window 450 illustrated in FIGS. 9-10B, the angles of the inner surface 552 and outer surface 554 with respect to level 556 may reduce and/or prevent the accumulation of air bubbles on the inner surface 552 of the window 550 and fluid droplets on the outer surface 554 of the window 550 as described above, due to the rotation of a system in which the x-ray tube 10 of FIG. 12 is implemented. In contrast to the window 450 of FIGS. 9-10B, the isosceles trapezoid cross-section of the window 550 may cause air bubbles on the inner surface 552 and fluid on the outer surface 554 to move or slide towards the same side of the window 550, that is, towards window attachment flange 76, rather than towards opposite sides of the window 450 as illustrated in FIG. 10B.

It will be appreciated that the specific examples described herein are not mutually exclusive and can be combined in a variety of ways. For instance, x-ray windows having an at least partially convex inner surface and an at least partially convex outer surface are contemplated within embodiments of the invention. Alternately or additionally, embodiments of the invention may include x-ray windows having an at least partially convex inner surface and an angled, substantially planar outer surface, or vice versa. Alternately or additionally, embodiments of the invention may include x-ray windows having angled, substantially planar inner and outer surfaces. Alternately or additionally, embodiments of the invention may include x-ray windows having angled, substantially planar inner and/or outer surfaces and a periphery that is substantially circular, square, elliptical, polygonal, or rectangular in shape, or the like or any combination thereof.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for constructing an x-ray transmissive window, comprising:

designing and constructing an inner surface arranged for contact with an x-ray system cooling fluid and configured to substantially prevent bubbles present in the x-ray system cooling fluid from accumulating on the inner surface in a beam path area of the inner surface;

designing and constructing an outer surface disposed opposite the inner surface and configured to substantially prevent fluid droplets from accumulating on the outer surface in a beam path area of the outer surface by causing the fluid droplets to move towards an outer periphery of the window; and wherein the inner surface and the outer surface define a non-uniform cross-sectional shape at least in a region of the beam path areas.

2. A method for constructing the window of claim 1, wherein the inner surface and outer surface define a bi-convex cross-sectional shape at least in a region of the beam path areas, wherein the orientation of the convex curvature of the inner surface is oriented in a direction that is opposite to the direction of the orientation of the convex curvature of the outer surface, and the curvature of the inner surface is described by a first radius and the curvature of the outer surface is described by a second radius.

3. A method for constructing the window of claim 2, wherein the first radius is substantially equal to the second radius.

4. A method for constructing the window of claim 2, wherein the first radius is different from the second radius.

5. A method for constructing the window of claim 1, wherein the outer surface includes a convex central portion that extends outwards towards an exterior of the x-ray device, and an outer portion defining a frustoconical shape, the outer portion annularly disposed about the central portion.

6. A method for constructing the window of claim 5, wherein the inner surface includes a convex central portion and an outer portion defining a frustoconical shape, the outer portion annularly disposed about the central portion.

7. A method for constructing the window of claim 1, wherein the outer surface includes a convex central portion that extends outwards towards an exterior of the x-ray device, and that is bounded by a plurality of substantially planar flat portions, each of the flat portions being configured to be angled with respect to level when the window is implemented in an x-ray system.

8. A method for constructing the window of claim 7, wherein the window has a substantially rectangular outer periphery.

9. A method for constructing the window of claim 7, wherein the inner surface includes a convex central portion bounded by a plurality of substantially flat portions.

10. A method for constructing the window of claim 1, wherein the inner surface is at an angle different than the outer surface such that the inner surface and outer surface define a cross section that is relatively thicker at a first end of the window than at a second end of the window.

11. A method for constructing the window of claim 1, wherein the outer periphery of the window includes a substantially flat rim surface.

12. An x-ray device, comprising:

a vacuum enclosure within which is disposed an electron-producing cathode and an anode positioned to receive electrons produced by the cathode;

an outer housing within which is disposed the vacuum enclosure and a cooling fluid;

an x-ray transmissive window positioned in the outer housing and having an x-ray beam path area, the x-ray transmissive window including an outer surface and an inner surface, the inner surface arranged for contact with the cooling fluid, wherein the outer surface is configured so as to substantially prevent fluid droplets from accumulating on the outer surface in the beam path area by causing the fluid droplets to move towards an outer periphery of the beam path area, wherein the inner surface and the outer surface are both at least partially convex in shape in the region of the beam path area; and wherein the inner surface and the outer surface define a non-uniform cross-sectional shape at least in a region of the beam path area.

13. The x-ray device of claim 12, wherein the inner surface is configured to prevent bubbles present in the cooling fluid from accumulating on the inner surface.

14. The x-ray device of claim 12, wherein the inner surface is shaped in a central region of the window such that it extends inwards towards an interior of the x-ray device and the outer surface is shaped in the central region such that it extends outwards towards an exterior of the x-ray device.

15. The x-ray device of claim 12, wherein each of the inner surface and the outer surface is described by one of: a single radius or multiple radii.

16. An x-ray device, comprising:

a vacuum enclosure within which is disposed an electron-producing cathode and an anode positioned to receive electrons produced by the cathode;

an outer housing within which is disposed the vacuum enclosure and a cooling fluid;

an x-ray transmissive window positioned in the outer housing and having an x-ray beam path area, the x-ray transmissive window including an outer surface and an inner surface, the inner surface arranged for contact with the cooling fluid, wherein the outer surface is configured so as to substantially prevent fluid droplets from accumulating on the outer surface in the beam path area by causing the fluid droplets to move towards an outer periphery of the beam path area, wherein the inner surface and the outer surface are both substantially planar and not parallel to one another, each of the inner surface and the outer surface being angled with respect to level such that the x-ray transmissive window is thicker at a first end of the x-ray transmissive window then at a second end of the x-ray transmissive window.

17. The x-ray device of claim 16, wherein:

the inner surface is arranged at a different angle than the outer surface.

18. An x-ray device according to claim 16, wherein the inner and outer surface of the x-ray transmissive window create a substantially trapezoidal cross section.

19. An x-ray transmissive window, comprising:

an inner surface arranged for contact with an x-ray system cooling fluid and configured to substantially prevent bubbles present in the x-ray system cooling fluid from accumulating on the inner surface in a beam path area of the inner surface;

an outer surface disposed opposite the inner surface and configured to substantially prevent fluid droplets from accumulating on the outer surface in a beam path area of the outer surface by causing the fluid droplets to move towards an outer periphery of the window; and wherein each of the inner surface and outer surface in a central region of the window is a substantially planar surface, each of the inner surface and outer surface being arranged to be at an angle relative to level when the window is implemented in the x-ray system.

20. The window of claim 19, wherein the inner surface is at an angle different than the outer surface such that the inner surface and outer surface define a cross section that is relatively thicker at a first end of the window than at a second end of the window.

21. An x-ray device, comprising:

a vacuum enclosure within which is disposed an electron-producing cathode and an anode positioned to receive electrons produced by the cathode;

an outer housing within which is disposed the vacuum enclosure and a cooling fluid;

an at least partially bi-convex x-ray transmissive window positioned in the outer housing and having an x-ray beam path area, the x-ray transmissive window including a convex outer surface and a convex inner surface, the convex inner surface arranged for contact with the cooling fluid, wherein the convex outer surface is configured so as to substantially prevent fluid droplets from accumulating on the outer surface in the beam path area by causing the fluid droplets to move towards an outer periphery of the beam path area.

* * * * *